United States Patent [19]

Schnell

[11] 4,074,776

[45] Feb. 21, 1978

[54] DIESEL PILE-DRIVING RAM

[75] Inventor: Hans Günther Schnell, Hamburg, Germany

[73] Assignee: Van Kooten B.V., Naarden, Netherlands

[21] Appl. No.: 637,985

[22] Filed: Dec. 5, 1975

[30] Foreign Application Priority Data

Dec. 10, 1974 Netherlands ..... 7416086

[51] Int. Cl.[2] ..... E02D 7/12

[52] U.S. Cl. ..... 173/137; 123/46 H; 173/133

[58] Field of Search ..... 173/135, 134, 137, 128, 173/131, 132; 123/465 K, 46 H, 46 R

[56] References Cited

U.S. PATENT DOCUMENTS

| | | | |
|---|---|---|---|
| 2,792,876 | 3/1957 | Dyer | 123/46 SC X |
| 3,303,892 | 2/1967 | Nishimura et al. | 173/135 X |
| 3,679,005 | 7/1972 | Inaba et al. | 173/128 |

FOREIGN PATENT DOCUMENTS

| | | | |
|---|---|---|---|
| 1,167,275 | 4/1964 | Germany | 173/137 |

*Primary Examiner*—Ernest R. Purser
*Assistant Examiner*—William F. Pate, III
*Attorney, Agent, or Firm*—Lewis H. Eslinger

[57] ABSTRACT

In a Diesel pile-driving ram comprising a combustion cylinder, a striker extending into the combustion cylinder, a piston housed in the combustion cylinder and a fuel injector for the supply of fuel between the impact surfaces of the piston and the striker, the impact surface of the striker is orientated in such a manner towards an annular precombustion chamber of a compression space provided between the piston and the striker, that the fuel atomized by impact ignites in the precombustion chamber. Said fuel, however, has too little air in said chamber in order to ignite immediately. The ignition is delayed for a moment but not too strongly because the precombustion chamber communicates with the main combustion chamber through an ample, annular passage of short length in an axial direction.

3 Claims, 9 Drawing Figures

FIG.1
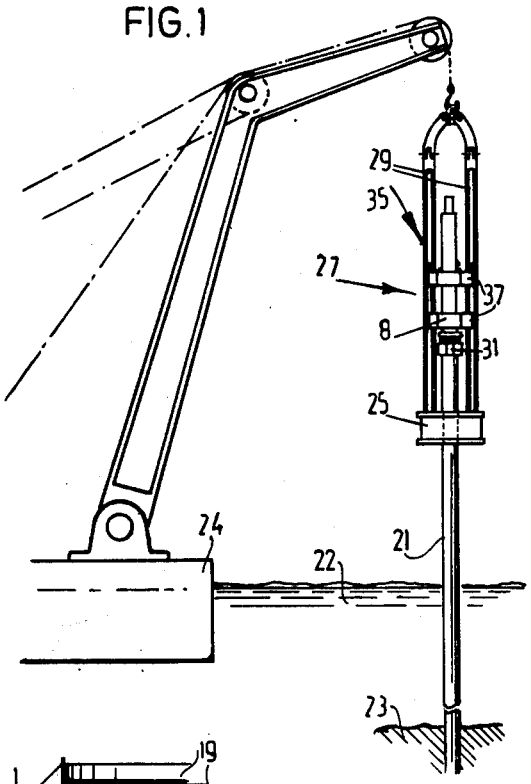
FIG.2
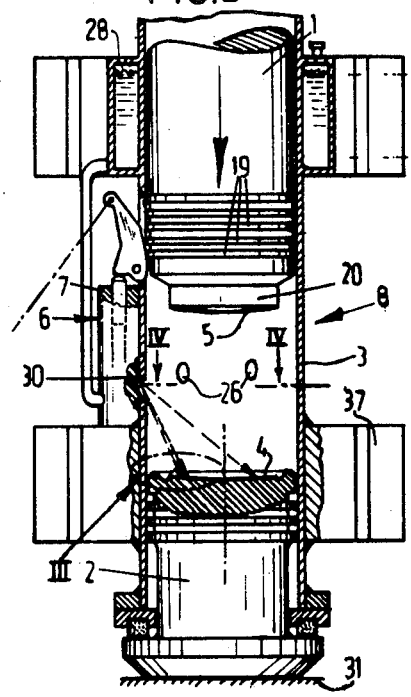
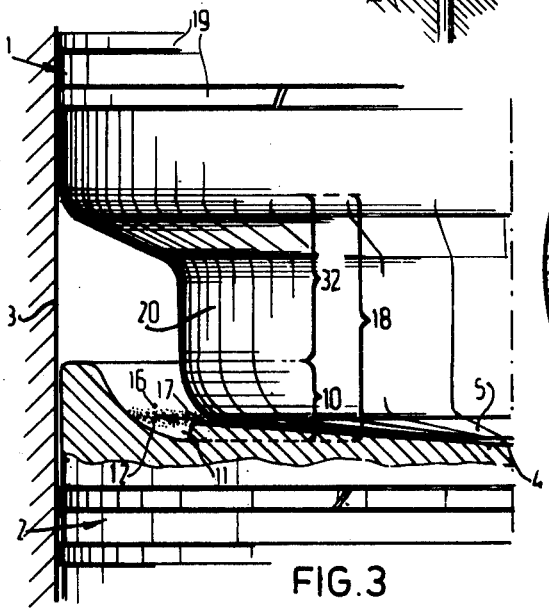
FIG.3
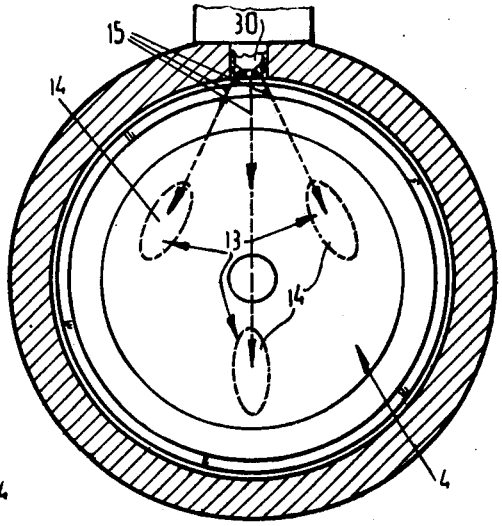
FIG.4

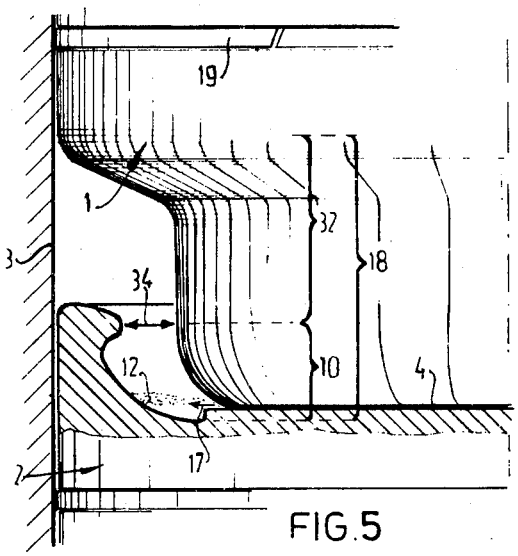
FIG.5
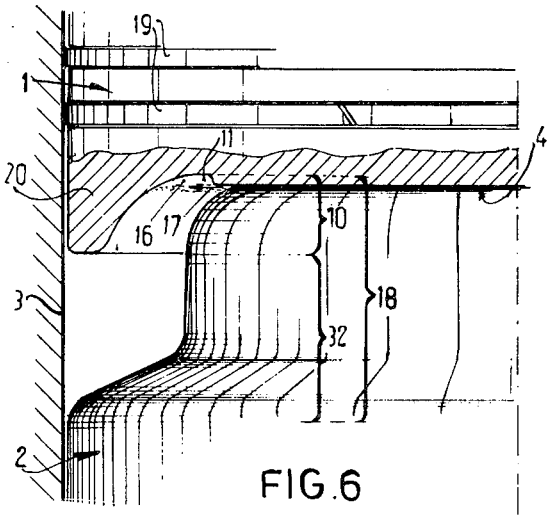
FIG.6
FIG.7
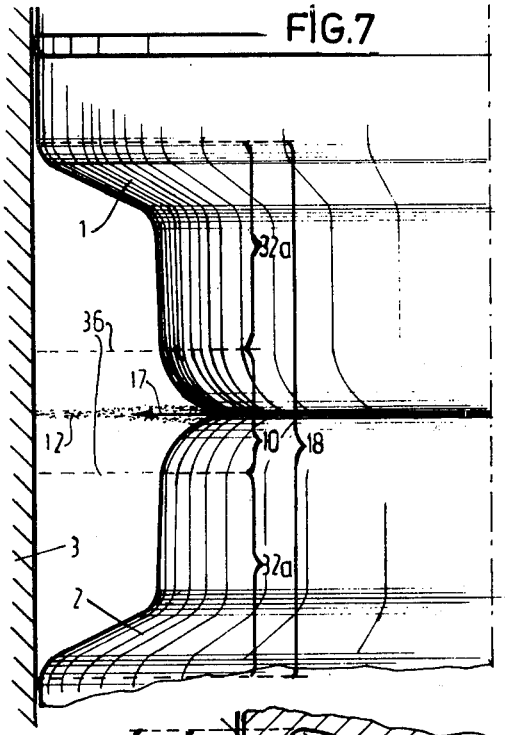
FIG.8
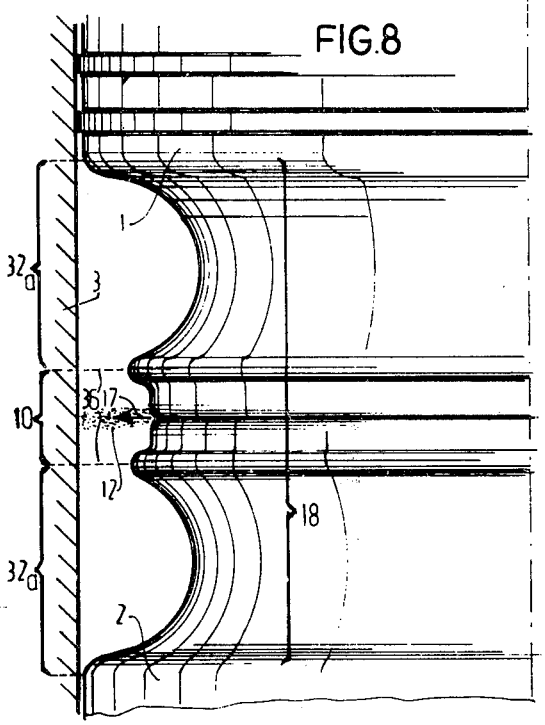
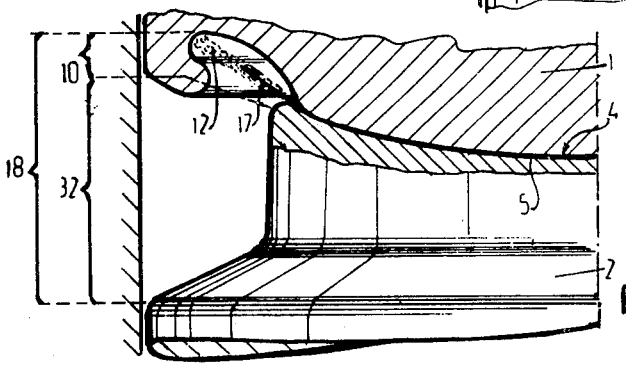
FIG.9

DIESEL PILE-DRIVING RAM

In the conventional Diesel pile-driving ram comprising a combustion cylinder, a striker extending into the combustion cylinder, a piston housed in the combustion cylinder and a fuel injector for the supply of fuel between the impact surfaces of the piston and the striker the impact surface of the striker is orientated towards an annular compression space provided between the piston and the striker in a manner such that the fuel atomized by impact flies transversely across the whole compression space so that the air present therein is directly mixed with fuel and the combustion can take place rapidly and smoothly. Under normal operation conditions this pile-driving ram, when used for driving piles into a solid ground, operates to the satisfaction of the expert, but when piles have to be driven into a weak ground it has the disadvantage that the fuel atomized by impact is not ignited. Therefore, technical proposals have been made to improve the ignition conditions so that even when driving piles into a weak ground the ignition is ensured. For example, in U.S. Pat. No. 2,792,816 and German laid out application 1,167,275 it is proposed to introduce the fuel atomized by impact into a precombustion chamber, whose compression force materially exceeds the compression force in the main combustion chamber so that the air coming into contact with the atomized fuel is subject to an additional rise in temperature which safeguards the ignition. These known Diesel rams comprising a precombustion chamber have the disadvantage that the overall combustion is not satisfactorily performed. There may first be an explosion in the precombustion chamber after which a second explosion takes place in the main combustion chamber. It may even be imagined that the explosion in the main combustion chamber becomes insignificant.

The invention relates to a Diesel pile-driving ram comprising at least one combustion cylinder, a striker extending into the combustion cylinder, a piston arranged in the combustion cylinder and a fuel injector for the supply of fuel between the impact surfaces of the piston and the striker, in which between the piston and the striker there is provided a compression space including at least one annular main combustion chamber and at least one annular precombustion chamber communicating with the former and in which the impact surface of the striker is orientated towards the precombustion chamber. A Diesel ram of this kind is known from U.S. Pat. No. 2,792,816 and German laid out application No. 1,167,275. Despite the fact that the Diesel pile-driving rams of the last-mentioned kind have an effect which is considerably inferior to that of the conventional ram the invention tends to improve this Diesel ram so that it operates even more satisfactorily than the classical ram, since the precombustion chamber is caused to communicate through an ample passage of short dimension in the axial direction with the main combustion chamber. The precombustion chamber does not contain sufficient air to cause the whole quantity of fuel to ignite rapidly. As a result the piston bears slightly longer on the driver before the ignition has reached the extent at which the piston is lifted. When applying the invention the transfer of energy at each stroke of the ram on the pile is considerably greater. Particularly in driving piles into solid ground the result is materially better than the result with which the expert has hitherto to be satisfied.

When carrying out the invention, not only the transfer of energy from the Diesel ram to the pile has improved, but also, in a later stage of the impact process, the piston can better engage the pile than at the beginning of the impact process, when the pile is still rapidly moving down. Therefore, when applying the invention the piston jumps upwards to a higher level, which is particularly important in the event of a weak ground and of the impact process. The piston, which is lifted to a higher level above weak ground as compared with conventional and other known Diesel pile-driving rams drops down with greater speed at the next impact so that adequate atomization is obtained for ensuring the next ignition.

It should be noted that German Patent Specification 838,515 discloses a Diesel pile-driving ram in which instead of impact atomization vaporisation of the fuel in a heated, separated pan takes place, after which air with the gaseous fuel is passed at a high rate whirling through the whole compression space in order to obtain a homogeneous, highly inflamable mixture. The instant of explosion in such a ram cannot be controlled satisfactorily.

According to the invention an additional deceleration of the inflamation is achieved by causing the precombustion chamber to communicate with at least one main combustion chamber through a restricted, ample passage.

The invention will be explained in the following description with reference to a drawing.

In the drawing show schematically:

FIG. 1 a survey of the operation of a pile-driver equipped with a ram in accordance with the invention, FIG. 2 on an enlarged scale a vertical sectional view of a pile-driving ram as shown in FIG. 1, FIG. 3 on an enlarged scale a preferred embodiment of a detail III of FIG. 2 in a different position, FIG. 4 on an enlarged scale a sectional view taken on the line IV—IV in FIG. 2, and FIGS. 5 to 9 each a variant of the detail shown in FIG. 3.

A pile driver 27 is arranged on a pile 21 to be driven into a soil 23 beneath the water 22 by means of a floating derrick 24. This pile driver 27 comprises a guide frame 35 comprising a socket 25 surrounding the pile 21 and two guide stays 29 secured thereto. The pile driver 27 furthermore comprises a ram 8, particularly a Diesel ram, guided by means of guide members 37 along the stays 29 and a cap 31 bearing on the pile 21.

FIG. 2 shows that the ram 8 comprises a combustion cylinder 3, a piston 1 operating as a hammer in said cylinder and a striker 2 bearing on the pile cap 31 and extending into the combustion cylinder 3. The combustion cylinder 3 holds a tank 28 and has ports 26 for admitting air and giving off exhaust gases and at least one fuel injection nozzle 30 of a fuel injector 6.

By means of piston rings 19 the piston 1 is sealed from the combustion cylinder 3 and has a piston head 20, which is surrounded by an annular compression chamber 18. A conical impact surface 4 of the striker 2 matches the engaging impact surface 5 of the piston 1.

FIG. 4 shows that fuel is sprayed at a plurality of areas distributed along the circumference of the impact surface 4 onto said surface, for example, by three jets 15 from the nozzle 30 so that three fuel zones 13 are formed. When the piston 1 strikes the striker 2, the fuel is satisfactorily atomized and scatters like a curtain 12 in the direction 17 from the impact surface 4 as far as into the lower part 16 of a precombustion chamber 10 of the compression chamber 18, since a shallow, annular recess 11 joining the impact surface 4 is provided in the striker 2. The fuel is then ignited in the precombustion chamber 10 and the combustion takes place slightly later in the main combustion chamber 32. This delay of the combustion process provides a considerable improvement of the impact effect of the ram 8. Owing to the fine particles the well atomized fuel ignites satisfactorily even with a small length of the stroke of the piston 1, but the inflamation is slow owing to lack of air in the combustion chamber 10.

In order to obtain an additional delay of the combustion the precombustion chamber 10 communicates, as is shown in FIG. 5, via a construction 34 with the main combustion chamber 32.

FIG. 6 shows in principle the reverse of FIG. 3: the piston 1 of FIG. 6 has the shape of the striker 2 of FIG. 3 and the striker 2 of FIG. 6 has the shape of the piston 1 of FIG. 3. FIG. 6 shows that the precombustion chamber 10 may, if desired, be arranged above the main combustion chamber 32. The precombustion chamber 10 is, for example, 20 to 40% of the compression chamber 18.

FIG. 7 shows that the fuel is sprayed in the direction of the arrow 17 into a precombustion chamber 10, which is arranged centrally of the compression chamber 18 between two compartments **32*a* of the main combustion chamber 32. This precombustion chamber 10 is obtained by using an elongated compression chamber 18 so that the exchange of the fuel-rich air of the precombustion chamber 10 against the fuel-poor air from the main combustion chambers 32*a* is impeded. The boundaries 36 between the precombustion chamber 10 and the main combustion chambers 32*a* are not clearly defined in FIG. 7. FIG. 8 shows a compression chamber 18 operating in practically the same manner, but having better defined boundaries 36**.

FIG. 9 shows spherical impact surfaces 4 and 5 of the striker 2 and the piston 1, which spray fuel in an inclined direction 17 as far as into a precombustion chamber 10 arranged above the main combustion chamber 32.

What I claim is:

1. A diesel pile-driving ram comprising at least one combustion cylinder, a striker extending into the combustion cylinder, a piston housed in the combustion cylinder said striker and piston having generally complementary impact surfaces which mate with one another; and a fuel injector for supplying fuel between the impact surfaces of the piston and the striker, said striker and piston having peripheral surface portions adjacent their respective impact surfaces and being spaced from said cylinder to define a compression space in the cylinder when the striking surfaces of the piston and the striker are engaged, said compression space including at least one annular main combustion chamber and at least one annular precombustion chamber communicating with the former, said precombustion chamber being generally smaller than said main combustion chamber and located immediately adjacent the impact surfaces of the striker and piston to receive fuel sprayed from said impact surfaces upon impact of the striker and piston, said precombustion chamber communicating with the main combustion chamber through an annular passage of short length in an axial direction.

2. A diesel pile-driving ram comprising, a combustion cylinder, a striker in said cylinder, a piston located in said cylinder for cooperation with said striker; said striker and piston having generally complementary impact surfaces which mate with one another, fuel injector means for supplying fuel between the impact surfaces of the piston and striker; said piston and striker having predetermined configurations defining an annular precombustion chamber surrounding said impact surfaces when the striking surfaces of the piston and striker are engaged and located to receive atomized fuel sprayed radially outwardly from between said impact surfaces as a result of the impact therebetween; and an annular main combustion chamber axially adjacent to and communicating with said precombustion chamber through an annular passage having a relatively short axial length.

3. A diesel pile-driving ram as defined in claim 2 wherein said precombustion chamber is formed in one of said striker and piston and comprises an annular recess surrounding the impact surface of the striker or piston in which it is formed.

* * * * *